US007301472B2

(12) United States Patent
Kyle et al.

(10) Patent No.: US 7,301,472 B2
(45) Date of Patent: Nov. 27, 2007

(54) BIG BORE TRANSCEIVER

(75) Inventors: Donald G. Kyle, Plano, TX (US); Adam D. Wright, Dallas, TX (US); Harold W. Nivens, Runaway Bay, TX (US); Kenny L. McConnell, Lewisville, TX (US); Vimal V. Shah, Sugarland, TX (US); Eric H. Van Empelen, Heemstede (NL)

(73) Assignee: Halliburton Energy Services, Inc., Houston, TX (US)

( * ) Notice: Subject to any disclaimer, the term of this patent is extended or adjusted under 35 U.S.C. 154(b) by 460 days.

(21) Appl. No.: 10/616,736

(22) Filed: Jul. 10, 2003

(65) Prior Publication Data

US 2004/0047235 A1 Mar. 11, 2004

(30) Foreign Application Priority Data

Sep. 3, 2002 (WO) ..... PCT/US02/27861

(51) Int. Cl.
*G01V 11/00* (2006.01)

(52) U.S. Cl. ..... 340/853.7; 367/81; 181/103

(58) Field of Classification Search ..... 340/854.3, 340/854.4, 853.7, 855.1; 367/83, 82; 166/313, 166/52, 53

See application file for complete search history.

(56) References Cited

U.S. PATENT DOCUMENTS

| | | | | |
|---|---|---|---|---|
| 4,314,365 | A * | 2/1982 | Petersen et al. | 367/82 |
| 6,137,747 | A | 10/2000 | Shah et al. | 367/81 |
| 6,177,882 | B1 | 1/2001 | Ringgenberg | |
| 6,470,996 | B1 * | 10/2002 | Kyle et al. | 181/103 |
| 6,626,248 | B1 * | 9/2003 | Roberts et al. | 175/5 |
| 6,899,178 | B2 * | 5/2005 | Tubel | 166/313 |

FOREIGN PATENT DOCUMENTS

| | | |
|---|---|---|
| EP | 773345 A | 5/1997 |
| EP | 0919697 | 2/1999 |
| EP | 919697 A | 6/1999 |
| GB | 2340520 A | 2/2000 |
| WO | WO92 06278 A | 4/1992 |

OTHER PUBLICATIONS

Office Action for Norwegian patent application No. 20035376 dated Mar. 29, 2007.

* cited by examiner

*Primary Examiner*—Brian Zimmerman
*Assistant Examiner*—Hung Q Dang
(74) *Attorney, Agent, or Firm*—Marlin R. Smith

(57) ABSTRACT

In a subterranean well completion a bi-directional signal transmission system includes an in-line acoustic transceiver mounted in a tubing string extending through the wellbore, the transceiver being disposed beneath a hanger structure engaging the tubing string. Via the tubing string the transceiver receives acoustic signals from well parameter sensing apparatus further downhole and converts the received acoustic signals to non-acoustic signals. The resulting non-acoustic signals are then transmitted upwardly through the hanger structure, to a signal receiving location, via cabling. In this manner, the hanger structure does not adversely affect the strength of either upwardly or downwardly transmitted signals traversing it. Alternatively, the acoustic well parameter signals received by the transceiver are converted to electromagnetic signals which pass through the earth, are picked up by a receiver external to the well completion, and then relayed to the receiving location.

44 Claims, 6 Drawing Sheets

BIG BORE TRANSCEIVER

CROSS-REFERENCE TO RELATED APPLICATION

This application claims the benefit under 35 USC §119 of the filing date of international application PCT/US02/27861 filed Sep. 3, 2002, the disclosure of which is incorporated herein by this reference.

TECHNICAL FIELD

The present invention relates generally to subterranean well apparatus and, in an embodiment described herein, more particularly provides an improved acoustic transmission system for use in subterranean well applications.

BACKGROUND

In subterranean well completions, of both surface and subsea types, a metal tubing structure such as production tubing is typically supported from an appropriate metal hanger structure and extends downwardly therefrom through the wellbore portion of the completion which is normally lined with a metal casing structure. It is often desirable to monitor the state of various downhole well parameters such as, for example but not by way of limitation, the temperatures and pressures within the tubing and external to the tubing in an annular space defined between the tubing and the casing. Many times the desired sensing locations for these well parameters are thousands of feet downhole. Thus, signals indicative of the sensed well parameters must correspondingly be tubing wall-transmitted upwardly through great distances via the wellbore (and a lengthy undersea riser in a subsea application) to a predetermined signal receiving location.

Various techniques have previously been proposed for generating and transmitting these well parameter signals. One such technique has been to transmit acoustic signals upwardly through the downhole metal wall portion of the tubing structure and then to the signal receiving location, via the wall portion of the remainder of the tubing structure, for conversion to, for example, digital or analog electrical signals.

A substantial impediment to successfully utilizing this acoustic-based signal transmission technique has been the necessary presence of a metal hanger structure from which the metal tubing structure is supported. In a subsea application, this metal hanger structure is typically a fluted hanger assembly, and in a surface application it is typically a slip structure. In either case, due to the metal-to-metal contact between the hanger structure and the tubing the hanger structure substantially dissipates an acoustic signal reaching it via a downhole portion of the tubing wall.

Accordingly, the acoustic signal reaching the tubing wall section uphole of the hanger structure is substantially weakened. In the case of a subsea well application, this weakened signal may then have to travel thousands of feet upwardly through the tubing wall above the hanger structure to reach the signal receiving location. Thus, the through-tubing acoustic transmission of downhole well parameter signals to a signal receiving location uphole of the well completion hanger structure has proven difficult, and in many applications unfeasible, to implement. A need thus exists for an improved acoustic-based signal transmission system in a well completion. A need additionally exists to transmit acoustical signals downwardly past the hanger structure, to a downhole location, to actuate devices and reconfigure acoustic transmission devices for better communications.

SUMMARY

In carrying out the principles of the present invention, in accordance with an embodiment thereof, a subterranean well completion is provided which comprises a wellbore extending into the earth, a tubular structure extending into the wellbore, and an acoustic energy dissipating well structure, representatively a hanger structure, which engages the tubular structure, with an upper portion of the tubular structure extending upwardly from the hanger structure, and a lower portion of the tubing structure extending downwardly from the hanger structure and through the wellbore.

The well completion, which may be a subsea completion or a surface-based completion, further comprises a specially designed signal transmission system operable to transmit an acoustic signal, representatively a downhole well parameter signal, upwardly through the lower tubing structure section toward the hanger structure from a downhole location, convert the acoustic signal to a non-acoustic signal at a location on the lower tubing structure section below the hanger structure, and transmit the converted, non-acoustic signal from an output section of the signal transmission system through a signal path structure coupled between the output section and a signal receiving location disposed above the hanger structure. Since the initially acoustic downhole well parameter signal is converted to a non-acoustic signal below the hanger structure, the substantial acoustic dissipation characteristic of the hanger structure does not appreciably weaken the signal eventually reaching the signal receiving location.

In an illustrated embodiment thereof, a signal transmission apparatus portion of the overall signal transmission system includes a lower transceiver structure connected in the lower tubing structure section below the hanger and operative to acoustically transmit the predetermined well parameter signal upwardly through the lower tubing structure section toward the hanger structure, and an upper transceiver structure, having a transceiver portion and a signal converting portion, disposed in the lower tubing structure portion between the hanger structure and the lower transceiver structure. The upper transceiver structure is representatively of a tubular configuration and has an axial bore with a diameter substantially equal to that of the lower tubing structure section, and receives the acoustic signal, converts it to a non-acoustic form, and outputs the converted signal to the signal path structure. The converted signal may, for example but not by way of limitation, be a digital or analog electric signal, a photoelectric signal, or an electromagnetic signal.

In one version of the well completion, the signal path includes a signal cable structure extending through the hanger structure and routed upwardly along the upper tubing structure section and through and/or around various well components mounted in the upper tubing structure section. In another version of the well completion, the signal path structure extends externally around the hanger structure and representatively includes a portion of the earth adjacent the upper transceiver structure. In this version, incorporated in a subsea embodiment of the well completion, the upper transceiver structure outputs electromagnetic wave signals which are propagated through the earth and received by a transmitter disposed on the sea bed and having an output cable for transmitting the received signal upwardly through the water to the signal receiving location.

Preferably, the signal transmission system is also capable of downwardly transmitting control signals, via the signal path structure and the tubing structure, to the lower transceiver structure to modify various aspects of the signal transmission system, including but not limited to changing the predetermined sensed downhole well parameter, changing the parameter value range associated with the downhole well parameter, changing the type of data transmitted by the lower transceiver structure, and changing the type of data transmitted by the lower transceiver structure. In addition, the downward transmission of control signals could be utilized to actuate downhole actuators such as valves or pumps to modify well test parameters.

DETAILED DESCRIPTION

Figure 1:
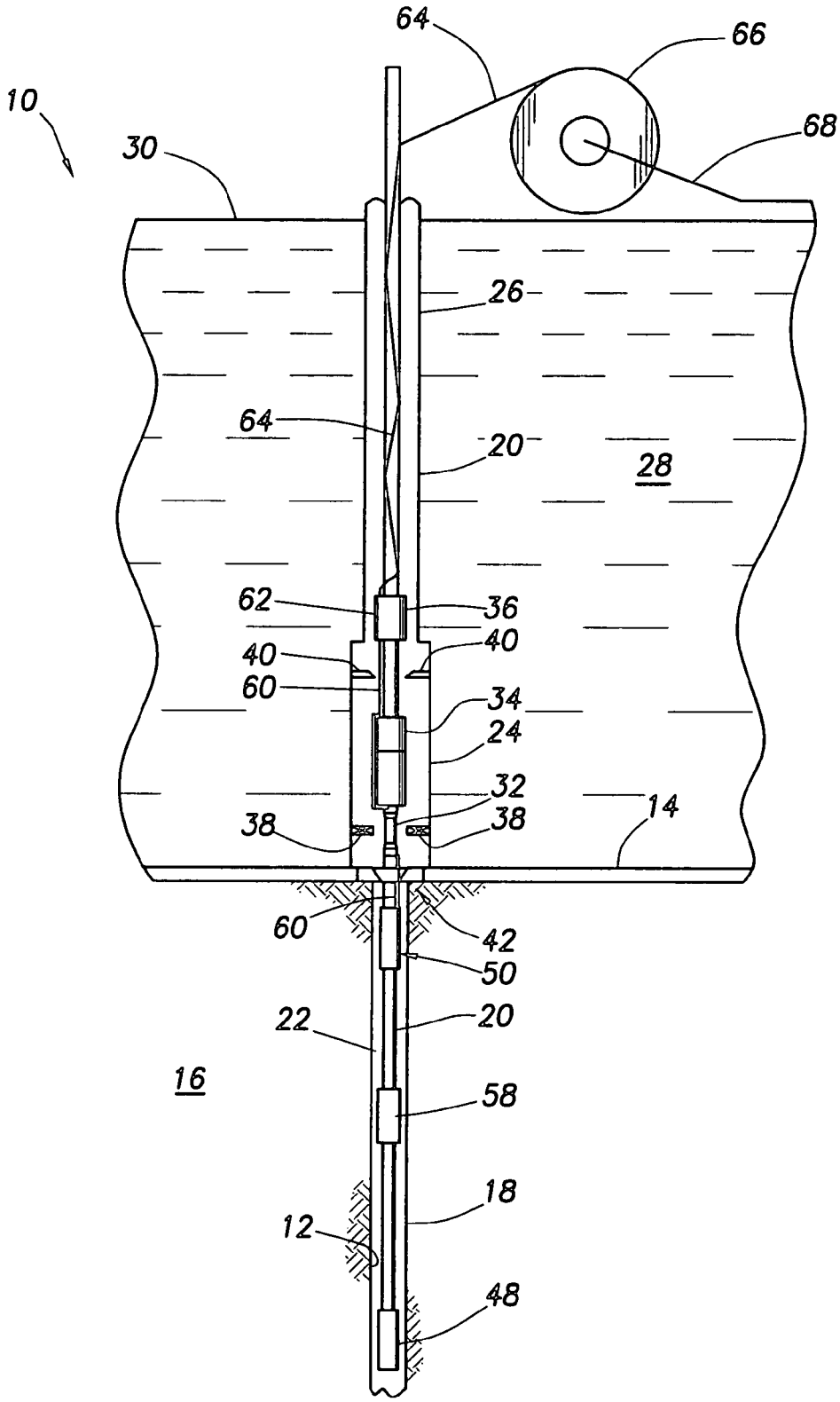
FIG. 1 is a schematic cross-sectional view through a portion of a representative subsea subterranean well completion having incorporated therein a specially designed acoustic transmission system embodying principles of the present invention.
Figure 2:
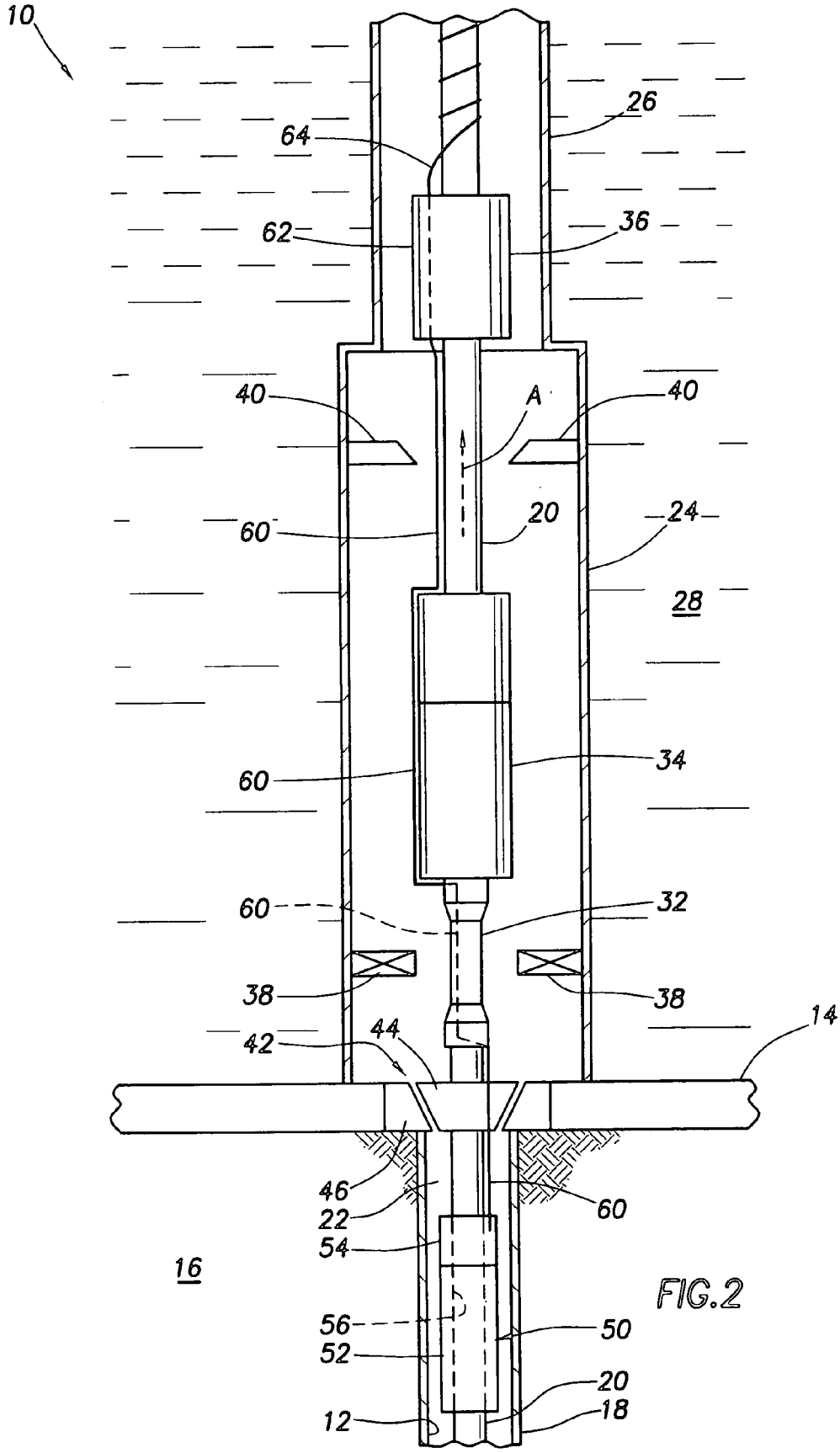
FIG. 2 is an enlargement of a portion of the FIG. 1 well completion.

Representatively and schematically illustrated in FIGS. 1 and 2 are longitudinal portions of a subsea subterranean well completion 10 which embodies principles of the present invention. In the following description of the well completion 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

With reference to FIGS. 1 and 2, the well completion 10 includes a representatively vertical wellbore 12 extending downwardly from the sea bed 14 into the underlying earth 16, the wellbore 12 being lined with a tubular metal casing 18 extending downwardly form the sea bed 14. A smaller diameter metal tubing structure 20 extends centrally through the casing 18 and forms therewith an annulus 22 laterally circumscribing the tubing 20. As illustrated, the tubing 20 has an upper section that extends upwardly from the sea bed 14 sequentially through an undersea wellhead/blowout preventer structure 24 and a tubular riser 26 extending upwardly from the structure 24 through the water 28 to a rig floor 30.

Operatively mounted in the section of the tubing 20 above the sea bed 14, and of conventional construction, are (from bottom to top as viewed in FIGS. 1 and 2) a longitudinally ported tubular slick joint 32, a subsea test tree 34, and an electrohydraulic module 36, the structures 32 and 34 being disposed within the wellhead/BOP (blow out preventer) structure 24, and the structure 36 being in the riser 26 above the wellhead/BOP 24. Disposed within the wellhead/BOP 24 are conventional ram and shear ram sets 38,40 that respectively oppose the slick joint 32 and a section of the tubing 20 between the test tree 34 and the electrohydraulic module 36.

Operatively disposed at sea bed level beneath the slick joint 32 is a conventional metal fluted tubing hanger structure 42 that includes a metal hanger member 44 anchored to the tubing 20, and a metal wear bushing structure 46 complementarily engaged by the metal hanger member 44. In a manner subsequently described herein, downhole well parameters (such as, but not limited to, pressures and temperatures within the tubing 20 and the annulus 22) are sensed and acoustic signals indicative of the sensed downhole well parameters are responsively transmitted upwardly through the metal wall of the downhole section of the tubing 20.

Conventional attempts to utilize acoustic well parameter indicating signals transmitted through the tubing, and ultimately received at an uphole signal converting station, have typically been frustrated by the presence of the hanger structure 42 which, due to its metal-to-metal contact with the tubing 20, substantially dissipates an acoustic signal traveling through the tubing upwardly through the hanger structure. Simply stated, the attenuated acoustic signal exiting the hanger structure via the tubing section above the hanger structure tends to be too weak to be useful.

To overcome this problem, the present invention incorporates in the well completion a specially designed acoustic-based signal transmission system which, as will now be described, generates acoustic well parameter signals in the wellbore below the hanger structure 42, transmits the acoustic signals upwardly through the tubing 20 to a conversion point therein downhole of the hanger structure 42 at which the acoustic signals are converted to a non-acoustic form, and then transmits the converted signals to a signal receiving location uphole from the hanger structure 42. In this manner the undesirable acoustic attenuation properties of the hanger structure 42 do not adversely affect the quality and strength of the well parameter signals ultimately reaching the signal receiving location.

With continuing reference to FIGS. 1 and 2, the acoustic transmission system includes a first acoustic transceiver structure 48 (see FIG. 1) which is of a suitable conventional construction and is representatively secured to the lower end of the tubing 20 within the cased wellbore 12. Transceiver or well tool structure 48 functions to monitor at least one downhole well parameter and responsively transmit an acoustic signal, which is indicative of the value of the sensed parameter, upwardly through the metal wall of the tubing 20 toward the hanger structure 42.

The acoustic transmission system also includes a second acoustic transceiver structure 50 which is secured in-line in the tubing 20 above the transceiver 48 and somewhat below the hanger structure 40. In a simplified uplink system, the second transceiver structure could consist of a suitable acoustic wave measurement sensor, and a signal amplifier, and a suitable packaging structure. The acoustic measurement sensor would convert the acoustic signals into non-acoustic signals, preferably electrical signals. The electrical signals could be amplified and transported to the surface by the signal amplifier. Equipment at the surface would decode the signals to obtain the downhole well parameters.

The transceiver structure 50 schematically depicted in FIGS. 1 and 2 representatively includes an acoustic transceiver 52 and an associated signal converter section 54. Transceiver 52 representatively has a resonant stack construction similar to a transceiver construction illustrated in U.S. Pat. No. 6,137,747 which is hereby incorporated herein by reference. A central circular bore 56, having a diameter substantially identical to that of the interior of the tubing 20, axially extends through the acoustic transceiver structure 50 between its upper and lower ends. Representatively, a suitable conventional acoustic signal repeater 58 (see FIG. 1) is mounted in the tubing 20 between the first and second acoustic transceiver structures 48,50.

During operation of the acoustic transmission system, at least one sensed well parameter signal is transmitted, in acoustic form, upwardly from the first acoustic transceiver structure 48, through the metal wall of the tubing 20, to the repeater 58 which, in turn, sends a corresponding acoustic signal through the tubing wall to the transceiver portion 52 of the upper acoustic transceiver structure 50.

According to a key aspect of the present invention, the signal converter section 54 of the upper transceiver structure 50, which is disposed below the hanger structure 42, receives these acoustic signals and converts them to non-acoustic signals such as, for example, digital electrical signals, analog electrical signals or photoelectric signals. These converted, non-acoustic signals are then transmitted to a remote signal receiving location (not illustrated) disposed, for example, on the rig (offshore) or wellsite (onshore). As illustrated in FIGS. 1 and 2, these converted, non-acoustic signals are routed upwardly from the signal converter portion 54 of the upper transceiver structure 50 to the signal receiving location via a signal transmission cable structure 60. Because acoustic signals are not passed upwardly through the hanger structure 42 (which, as previously discussed herein, is a structure which would otherwise greatly dissipate tubing-carried acoustic signals passing upwardly therethrough), the hanger structure 42 does not appreciably weaken well parameter and audio signals ultimately reaching the signal receiving location.

From its connection to the signal converter portion 54 the cable 60 sequentially passes upwardly through the hanger member 44, upwardly through a vertical sidewall port in the ported tubular slick joint 32, upwardly around the exterior of the subsea test tree 34, and upwardly along the exterior of an adjacent section of the tubing 20 to a cable connection portion 62 of the electrohydraulic module 36. From the electrohydraulic module 36 the converted signals are routed to the signal receiving location via electrohydraulic cabling 64 wrapped around an upper end portion of the tubing 20 and operatively connected to an electrohydraulic reel 66 (see FIG. 1) disposed on the rig. From the reel 66 the converted signals are routed to the signal receiving location via a schematically depicted electrical wire connection 68 coupled to the reel 66. Thus, as to the acoustic downhole well parameter and audio signals there is an acoustic signal transmission path disposed beneath the hanger structure 42, and a non-acoustic signal path which extends upwardly past the hanger structure 42 and forms at least a portion of the remaining signal path routed to the signal receiver location.

While this non-acoustic signal transmission path has been representatively depicted herein as being a cabled path, extending clear to the surface and carrying electric or photoelectric converted signals, other types of non-acoustic signal transmission paths could alternatively be provided above the hanger structure or other source of substantial attenuation of through-tubing acoustic signal strength. For example, as subsequently discussed herein, this non-acoustic signal transmission path extending above the hanger structure could include an electromagnetic path emanating from the signal converter 54. Alternatively, once the converted non-acoustic signal path upwardly passes the hanger structure 42, the non-acoustic signal could be re-converted to acoustic form and transmitted through an upper portion of the tubing 20 (as indicated by the dashed arrow "A" in FIG. 2) to the surface.

Since the signal transmission components 48,50 are both transceiver structures they are, of course, capable of both transmitting and receiving signals. In the well completion 10 representatively depicted in FIGS. 1 and 2, various control signals may also be transmitted (from the signal receiving location) through the overall illustrated signal path downhole to the lower transceiver structure 48. These control signals are sequentially transmitted in non-acoustic form through the cabling 62,60 through the hanger member 44, and then converted to acoustic form by the signal converter 54 and acoustically transmitted downwardly through the tubing wall, via the repeater 58, to the lower transceiver structure 48. The control signals sent in this manner to the transceiver structure 48 may be utilized in a variety of manners including, for example but not by way of limitation, to change in the lower transceiver structure the sensed downhole well parameter(s), the ranges of parameter value(s) sensed, the transmission frequency, or the type of data transmitted.

The representative signal transmission system just described may be incorporated in a variety of well completions having configurations different than that shown in FIGS. 1 and 2. For example, the subsea well completion embodiment 10*a* shown in FIG. 3 does not have an electrohydraulic module such as the electrohydraulic module 34 shown in FIG. 2. Accordingly, above the subsea test tree 34, the cable 60 is wrapped around the tubing 20 and extended to the surface for routing to the signal receiving location.

Figure 3:
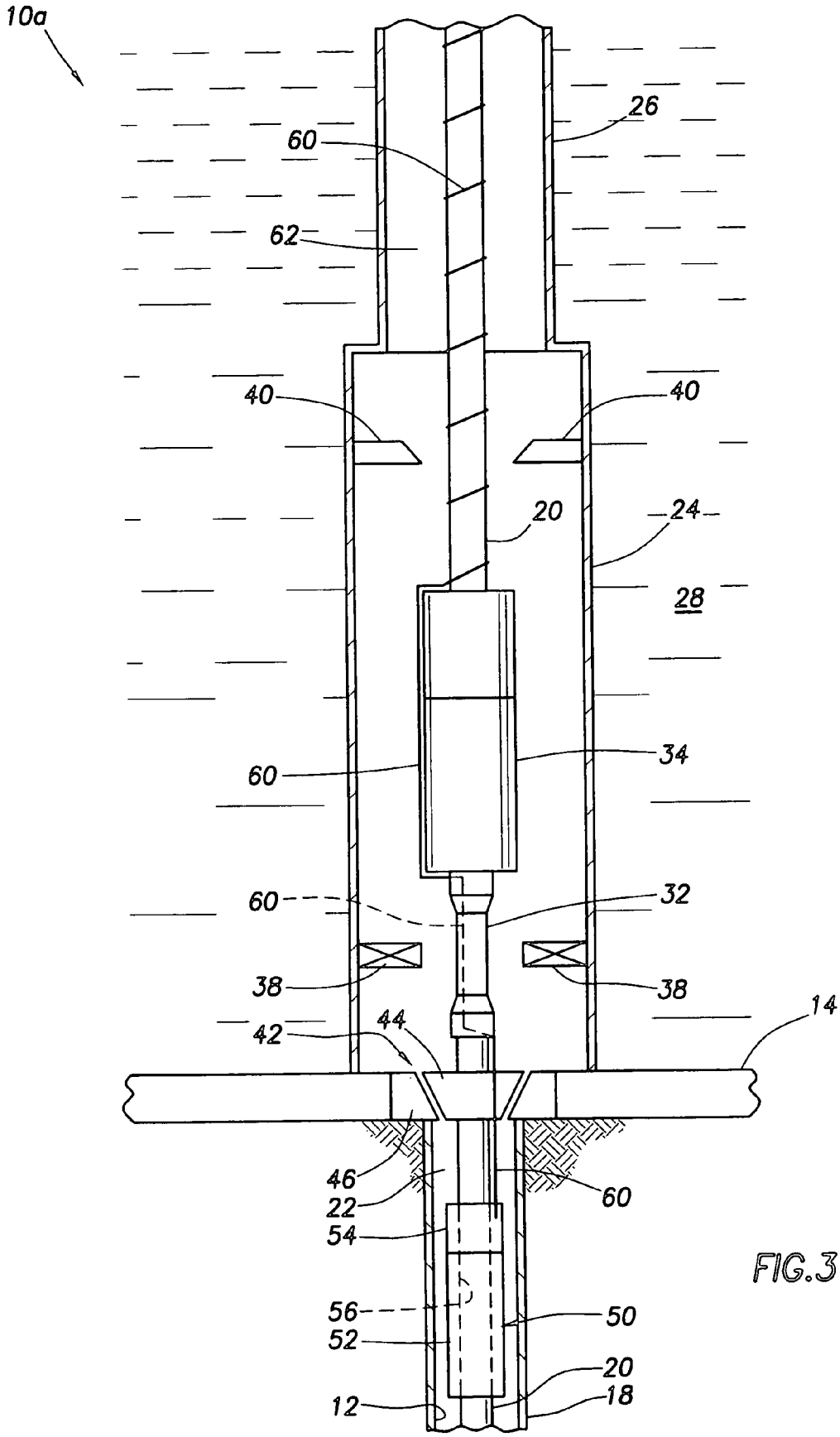
FIG. 3 is a schematic cross-sectional view of a portion of a first alternate embodiment of the FIG. 1 well completion.
Figure 4:
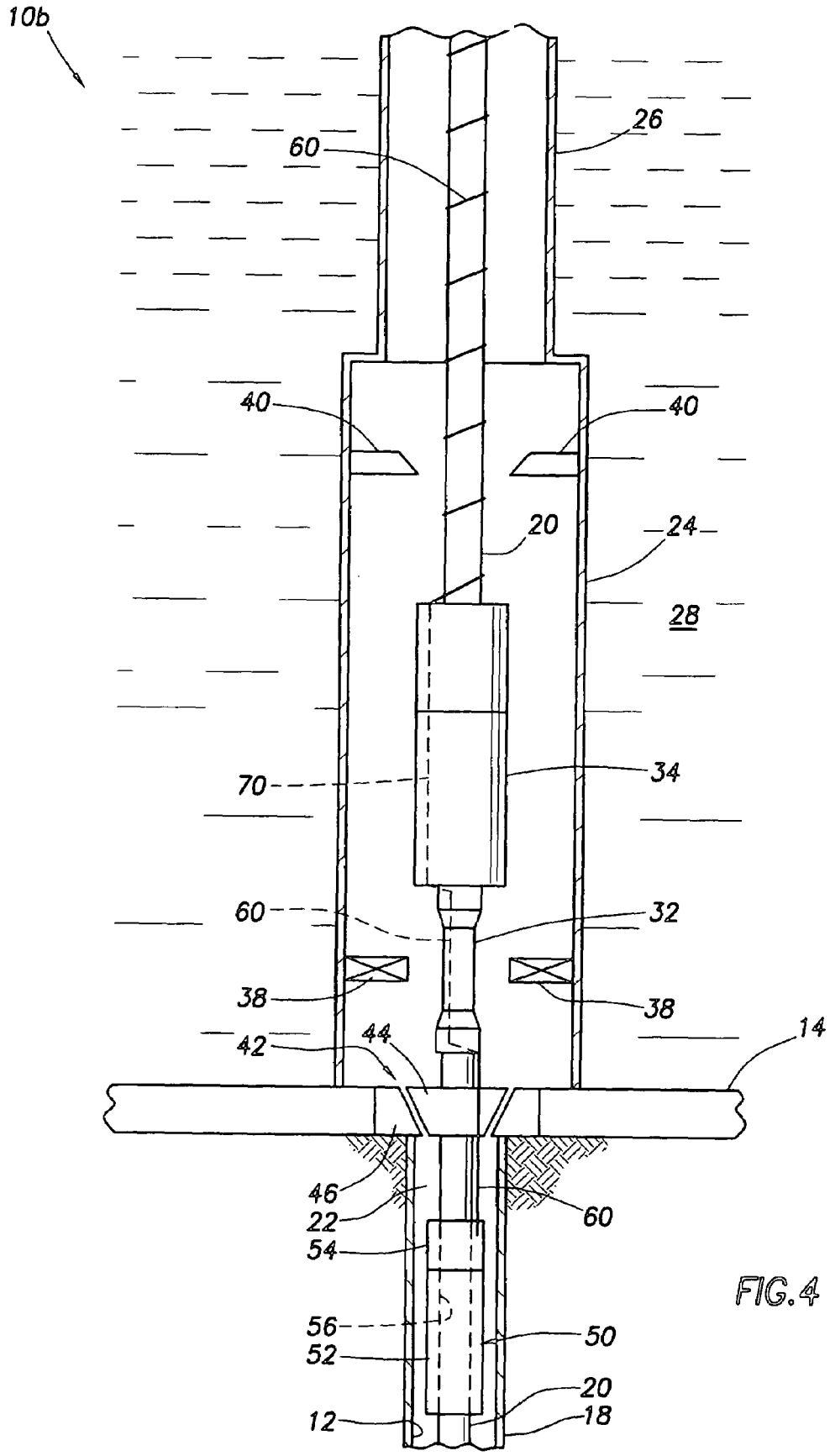
FIG. 4 is a schematic cross-sectional view of a portion of a second alternate embodiment of the FIG. 1 well completion.

The subsea well completion embodiment 10*b* shown in FIG. 4 is similar to that shown in FIG. 3, with the exception that the subsea test tree 34 has a built in electrical feed-through portion 70 to which portions of the cable 60 above and below the feed-through portion 70 are operatively connected.

Figure 5:
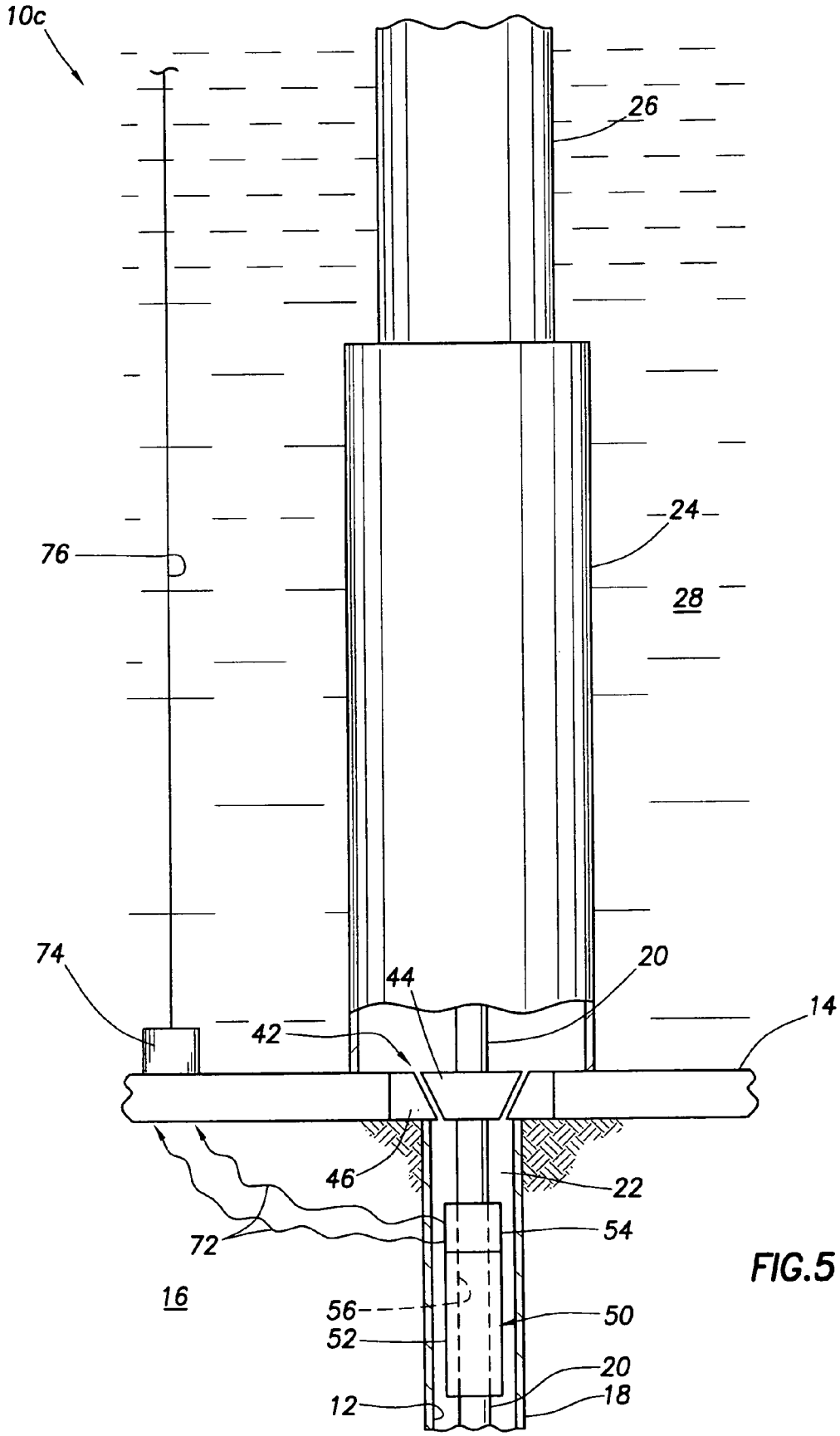
FIG. 5 is a schematic cross-sectional view of a portion of a third alternate embodiment of the FIG. 1 well completion.

As previously mentioned herein, the converted signal path which, in effect, "bypasses" the undesirable acoustic attenuation of the hanger structure 42 is not limited to a wholly or partly electrical or photoelectric nature. For example, in the subsea well completion embodiment 10*c* shown in FIG. 5, the signal converter portion 54 of the upper transceiver structure 50 is operative to convert its received acoustic signals to electromagnetic waves 72 which are transmitted through the earth 16 to a suitable transceiver structure 74 located on the sea bed 14 and coupled to a cable structure 76 extending upwardly through the water 28 to the signal receiving location. Upon receiving the electromagnetic signals 72, the transceiver structure 74 converts them to suitable electrical form for upward transmission through the cable structure 76. Of course, signals may also be transmitted downwardly through this overall transmission path to the upper transceiver structure 50 for transmission therefrom to the lower transceiver structure 48.

Figure 6:
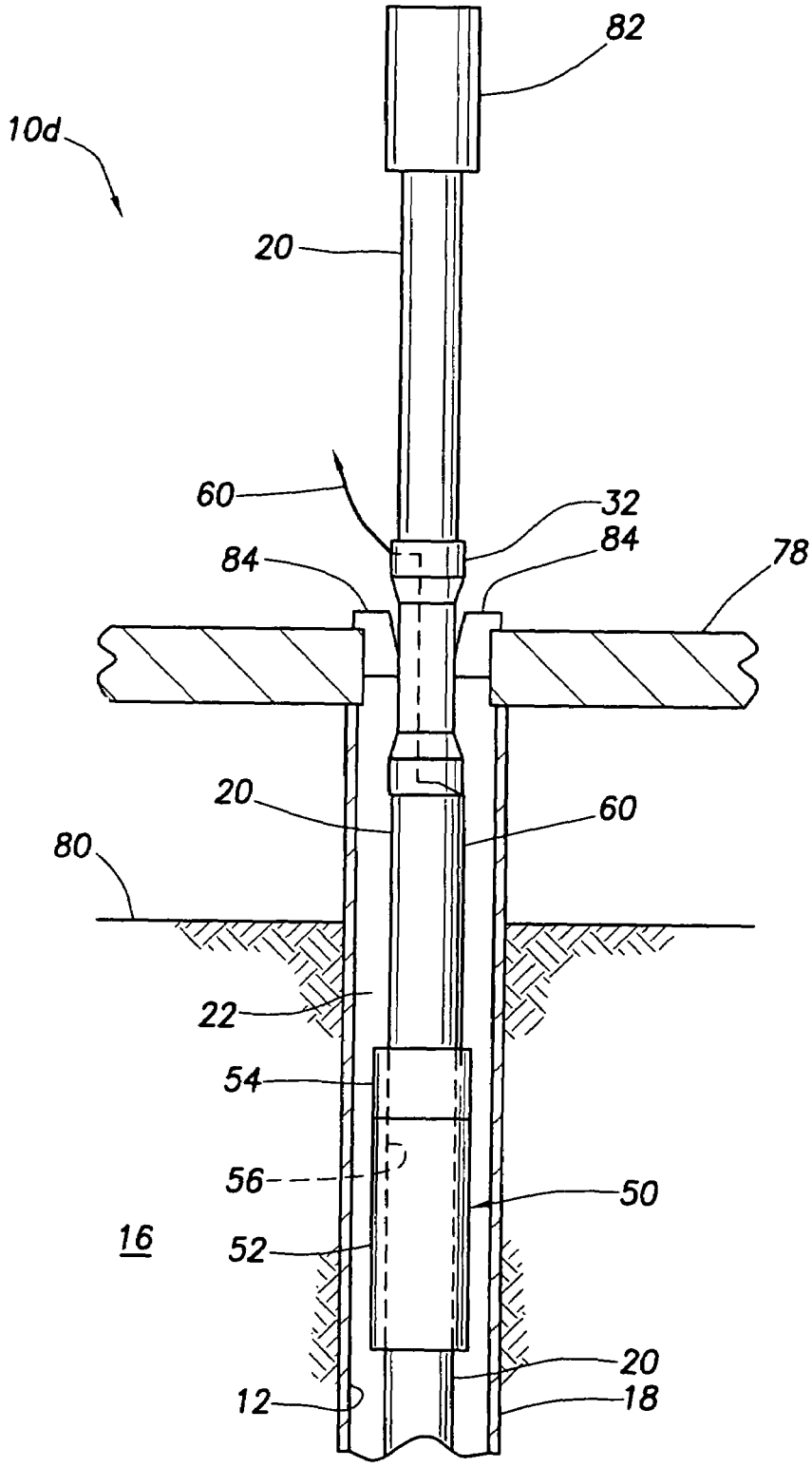
FIG. 6 is a schematic partly cross-sectional, partly elevational view of a non-subsea version of the FIG. 1 subterranean well completion.

The signal transmission system of the present invention may also be incorporated in a land-based well completion such as the well completion embodiment 10*d* schematically depicted in FIG. 6. In this well completion, in which a rig floor 78 is disposed above the earth's surface 80, and the tubing 20 extends upwardly from the ported tubular slick joint 32 to schematically depicted surface equipment 82, the acoustic-attenuating hanger structure is defined by metal slips 84 which engage the slick joint 32. In well completion 10*d*, the portion of the cable 60 upwardly exiting the slick joint 32 is appropriately routed to the signal receiving location.

The foregoing detailed description is to be clearly understood as being given by way of illustration and example only, the spirit and scope of the present invention being limited solely by the appended claims.

What is claimed is:

1. For use in a subterranean well completion having a welibore through which a lower section of a tubing structure extends downwardly from a well structure engaging the tubular structure and defining a substantial outward acoustic energy dissipation path at a juncture between the lower tubing structure and an upper tubing structure section disposed above the well structure, a well operation method comprising the steps of:

acoustically transmitting a downhole well parameter signal upwardly through the lower tubing structure section toward the well structure;

converting the acoustically transmitted signal to a non-acoustic signal at a tubing structure location below the well structure, the acoustic to non-acoustic conversion being performed in a signal converter which is fixedly interconnected as a part of the tubing structure; and transmitting the converted signal upwardly past the well structure along a signal path leading to a signal receiving location.

2. The method of claim 1 wherein:

the acoustically transmitting step includes the steps of:

connecting a first downhole transceiver structure to the lower tubing structure section, connecting a second downhole transceiver structure to the lower tubing structure section between the well structure and the first downhole transceiver structure, the second downhole transceiver structure including a transceiver portion and the signal converter, and transmitting acoustic signals from the first downhole transceiver structure through the lower tubing structure section to the transceiver portion of the second downhole transceiver structure, and the converting step is performed utilizing the signal converter of the second downhole transceiver structure.

3. The method of claim 1 wherein:

the converting step is performed by converting the acoustically transmitted signal to an electrical signal.

4. The method of claim 3 wherein:

the converting step is performed by converting the acoustically transmitted signal to a digital electric signal.

5. The method of claim 3 wherein:

the converting step is performed by converting the acoustically transmitted signal to an analog electrical signal.

6. The method of claim 3 wherein:

the converting step is performed by converting the acoustically transmitted signal to an electromagnetic wave signal.

7. The method of claim 3 wherein:

the converting step is performed by converting the acoustically transmitted signal to a photoelectric signal.

8. The method of claim 1 wherein:

the step of transmitting the converted signal is performed by routing the converted signal upwardly through the well structure.

9. The method of claim 8 wherein:

the routing step includes the step of extending a signal cable structure upwardly through the well structure.

10. The method of claim 9 wherein:

the well structure is a hanger structure.

11. The method of claim 1 wherein:

the step of transmitting the converted signal is performed by routing the converted signal upwardly around the well structure.

12. The method of claim 2 further comprising the step of:

transmitting a control signal downwardly through the signal path to the first downhole transceiver structure.

13. The method of claim 12 wherein:

the downhole well parameter signal is associated with a predetermined downhole well parameter, and the method further comprises the step of utilizing the control signal to change the predetermined downhole well parameter.

14. The method of claim 12 further comprising the step of:

utilizing the control signal to change the parameter value range associated with the downhole well parameter signal.

15. The method of claim 12 further comprising the step of:

utilizing the control signal to change the transmission frequency of the first downhole transceiver structure.

16. The method of claim 12 further comprising the step of:

utilizing the control signal to change the type of data transmitted by the first downhole transceiver structure.

17. The method of claim 2 wherein:

the step of transmitting acoustic signals from the first downhole transceiver through the lower tubing structure section to the transceiver portion of the second downhole transceiver is performed utilizing at least one signal repeater carried by the lower tubing structure section between the first and second transceiver structures.

18. A subterranean well completion comprising:

a wellbore extending into the earth;

a tubular structure extending into the wellbore;

an acoustic energy dissipating well structure engaging the tubular structure, with an upper portion of the tubular structure extending upwardly from the well structure, and a lower portion of the tubing structure extending downwardly from the well structure and through the wellbore; and a signal transmission system including:

signal transmission apparatus operable to transmit an acoustic signal upwardly through the lower tubing structure section toward the well structure from a downhole location, convert the acoustic signal to a non-acoustic signal using a signal converter fixedly interconnected as a part of the tubing structure at a location on the lower tubing structure section below the well structure, and transmit the converted, non-acoustic signal from an output section of the signal transmission apparatus, and a signal path structure coupled between the output section and a signal receiving location disposed above the well structure.

19. The subterranean well completion of claim 18 wherein:

the acoustic energy dissipating well structure is a hanger structure.

20. The subterranean well completion of claim 19 wherein:

the well completion is a subsea well completion, and the hanger structure is a fluted hanger structure.

21. The subterranean well completion of claim 19 wherein:

the well completion is a surface-based well completion, and the hanger structure is a slip structure.

22. The subterranean well completion of claim 18 wherein:

the signal transmission apparatus includes upper and lower longitudinally spaced transceiver structures carried by the lower tubing structure section.

23. The subterranean well completion of claim 22 wherein:

the upper transceiver structure includes the signal converter operable to output the converted, non-acoustic signal to the signal path structure.

24. The subterranean well completion of claim 22 wherein:

the acoustic signal is generated by the lower transceiver structure and is indicative of a predetermined sensed well parameter.

25. The subterranean well completion of claim 24 wherein:

the signal transmission system, via the signal path structure, is further operative to transmit a control signal downwardly through the lower tubing structure section.

26. The subterranean well completion of claim 25 wherein:

the signal transmission system is further operable to utilize the control signal to change the predetermined sensed downhole well parameter.

27. The subterranean well completion of claim 25 wherein:

the signal transmission system is further operable to utilize the control signal to change the parameter value range associated with the downhole well parameter.

28. The subterranean well completion of claim 25 wherein:

the signal transmission system is further operable to utilize the control signal to change the type of data transmitted by the lower transceiver structure.

29. The subterranean well completion of claim 22 further comprising:

at least one signal repeater carried by the lower tubing structure section between the upper and lower transceiver structures.

30. The subterranean well completion of claim 18 wherein:

the signal transmission system is operable to convert the acoustic signal to an electrical signal.

31. The subterranean well completion of claim 30 wherein:

the signal transmission system is operable to convert the acoustic signal to a digital electric signal.

32. The subterranean well completion of claim 30 wherein:

the signal transmission system is operable to convert the acoustic signal to an analog electrical signal.

33. The subterranean well completion of claim 18 wherein:

the signal transmission system is operable to convert the acoustic signal to an electromagnetic wave signal.

34. The subterranean well completion of claim 18 wherein:

the signal transmission system is operable to convert the acoustic signal to a photoelectric signal.

35. The subterranean well completion of claim 18 wherein:

the signal path structure extends through the well structure.

36. The subterranean well completion of claim 18 wherein:

the signal path structure includes a signal cable structure extending through the well structure.

37. The subterranean well completion of claim 18 wherein:

the signal path structure includes a signal cable structure extending upwardly along the upper tubing structure portion.

38. The subterranean well completion of claim 37 wherein:

the subterranean well completion is a subsea well completion having a test tree structure connected in the upper tubing structure section, and the signal cable structure extends externally around the test tree structure.

39. The subterranean well completion of claim 37 wherein:

the subterranean well completion further comprises an electrohydraulic module connected in the upper tubing structure section, and the signal cable structure extends interiorly through the electrohydraulic module.

40. The subterranean well completion of claim 37 wherein:

the subterranean well completion further comprises an electrohydraulic module connected in the upper tubing structure section, and the signal cable structure extends exteriorly around the electrohydraulic module.

41. The subterranean well completion of claim 37 wherein:

the well structure is a hanger structure, and the signal cable structure extends upwardly through a wall portion of the tubing structure at the hanger structure location.

42. The subterranean well completion of claim 41 wherein:

the wall portion is a wall portion of a ported slick joint extending through the hanger structure.

43. The subterranean well completion of claim 18 wherein:

the well completion is a subsea well completion, the signal transmission system is operable to convert the acoustic signal to an electromagnetic wave signal which is transmitted into and through an adjacent portion of the earth, and the signal path structure includes the adjacent earth portion, a transmitter structure positioned adjacent the sea bed and operable to receive the electromagnetic wave signal, and a signal output cable extending from the transceiver to the signal receiving location.

44. The subterranean well bore completion of claim 22 wherein:

the upper transceiver structure has a generally tubular configuration, is connected in-line with the lower tubing structure section, and has an axial bore with a diameter substantially identical to that of the interior diameter of the lower tubing structure section.

* * * * *